US005098309A

United States Patent [19]

Deak et al.

[11] Patent Number: 5,098,309

[45] Date of Patent: Mar. 24, 1992

[54] HIGH DENSITY CONNECTOR WITH CONTACT WIPE

[75] Inventors: Frederick R. Deak, Kernersville; David J. Goetzinger, Winston-Salem; Robert M. Renn, Pfafftown, all of N.C.

[73] Assignee: AMP Incorporated, Harrisburg, Pa.

[21] Appl. No.: 686,223

[22] Filed: Apr. 15, 1991

[51] Int. Cl.[5] ..... H01R 13/15

[52] U.S. Cl. ..... 439/260; 439/161

[58] Field of Search ..... 439/259, 260, 266, 267, 439/161, 630, 632, 635, 631

[56] References Cited

U.S. PATENT DOCUMENTS 3,922,054 11/1975 Dechelette ..... 439/260
4,488,766 12/1984 Cosmo ..... 439/260 X
4,587,596 5/1986 Bunnell ..... 439/260
4,629,270 12/1986 Andrews, Jr. et al. ..... 439/260
4,636,019 1/1987 Gillett et al. ..... 439/260 X
4,643,500 2/1987 Krumme ..... 439/161
4,892,487 1/1990 Dranchak et al. ..... 439/630 X

*Primary Examiner*—Larry I. Schwartz
*Assistant Examiner*—Khiem Nguyen

[57] ABSTRACT

A high density electrical connector (10) includes a flexible circuit (28) carrying circuit traces (32, 34) mounted on rod elements (38) driven by a cam means (60) to provide wipe and backwipe interconnections between board circuit traces (14, 18). A shape memory alloy (84) is employed to effect cam drive in one embodiment and an operating arm is utilized to effect cam drive in another embodiment.

11 Claims, 7 Drawing Sheets

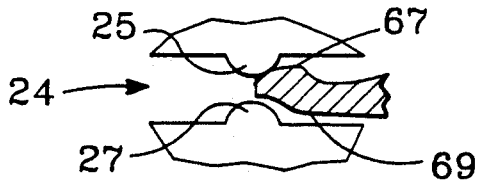
Fig. 10
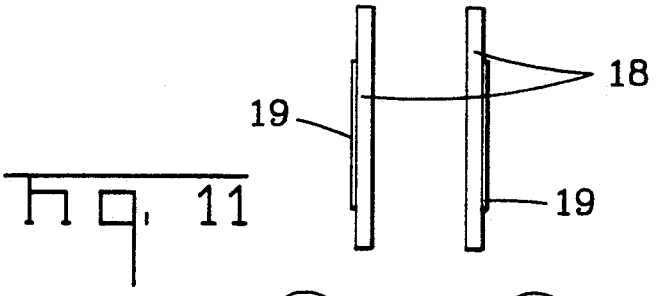
Fig. 11
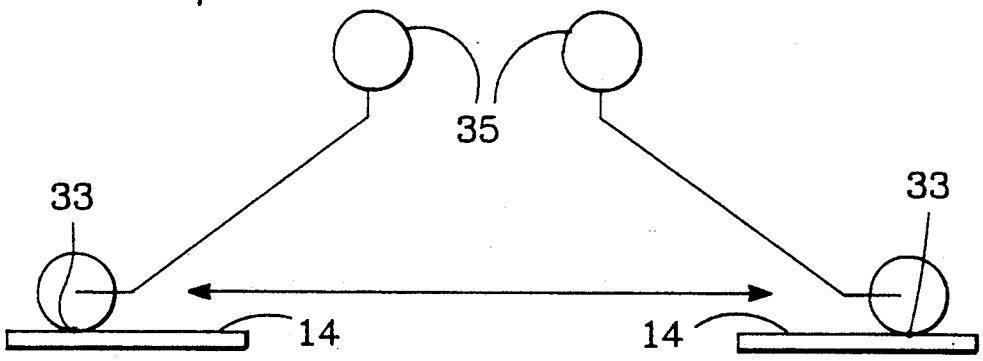
Fig. 12
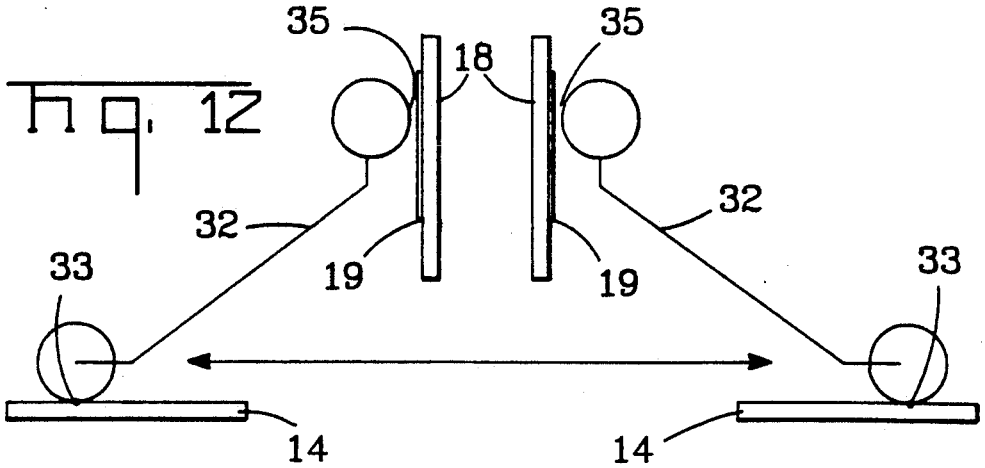

HIGH DENSITY CONNECTOR WITH CONTACT WIPE

This invention relates to a high density electrical connector for interconnecting the circuits of component carrying boards utilizing a mounting means having a cam to effect wipe and backwipe of contacts.

BACKGROUND OF THE INVENTION

When contacts are brought together to effect an electrical interconnection to interconnect the components of computer systems and the like, it becomes important that low resistance, stable signal paths are established. To this end, the circuits of components, as for example, those carried by printed circuit boards, typically include contacts which are plated with precious metal finishes such as gold or, in some instances, thin or alloys thereof, which are brought together with sufficient normal force to eliminate effects of surface-carried debris, insulating oxidation products, or other substances contaminating such contact surfaces. As a general rule, finishes, including gold alloys, have been employed to minimize the development of oxides which interfere with current flow, and in the case of the lower cost applications where tin or alloys of tin are used, relatively high forces are of necessity employed. For example, in gold finish systems, the forces may be on the order of 80 to 100 grams, while with tin finishes, the required normal force can range from 250 grams to more than 300 grams per contact. A classic improvement employed with both types of finishes is to provide a mechanism which wipes the contacts together under pressure, to penetrate contaminating films and clear debris from the path of contract. An even more refined technique is to use wipe upon closure of contacts with a backwipe wherein the contacts wind up in an area previously wiped clean by an initial engagement.

The foregoing techniques are well known and widely used throughout the interconnection industry wherein the contacts, connectors, and the like are relatively substantial in size and few in number. When applied to the developing high density connectors involving not just dozens of contacts, but hundreds of contacts per connector, located on centers of 0.050 inches and substantially less, to result in closure forces of 50 lbs. or more, the conventional structures for providing wipe and/or backwipe are inadequate.

Accordingly, it is an object of the invention to provide, with respect to a high density, high contact count connector, a simple structure for providing wipe and backwipe between rows of contacts. It is a further object to provide a high density, high contact count connector for interconnecting the contacts of printed circuit boards such as those on daughter boards to those on mother boards in a highly reliable wiping engagement. It is a still further object of the invention to provide a contact system having wipe and backwipe which can be automatically achieved through a particular cam/motor structure, including a shape memory alloy (SMA), thermally responsive motor.

SUMMARY OF THE INVENTION

The present invention attains the foregoing objectives through the use of a connector employing flexible circuits having closely centered circuit traces ending in contact pads arrayed to interconnect the contacts of a first printed circuit board and further contacts interconnecting the contacts of a second printed circuit board; with the circuit being supported by structurally rigid rod elements mounted on the first board having features to receive, hold, guide, and align the second board. A simple cam structure is provided in the means mounted on the first board and operable to drive the rod elements through vertically oriented cam surfaces in movement effecting wipe and backwipe in conjunction with spring means with the cam means further including horizontal surfaces adapted to engage the second board and effect wipe and backwipe movements through a displacement thereof relative to the first board and mounting means. The invention includes, in one embodiment, a manually operable lever arm to drive the cam means at each end of a second board and in an alternative embodiment, an SMA spring with means to provide a thermal input to such spring to cause it to drive the cam. The SMA spring thus serves as a motor which may be remotely driven to connect and disconnect first and second boards such as for example, the daughter boards to a mother board in electronic systems.

IN THE DRAWINGS

FIG. 10 is a sectional view of a portion of the cam surfaces of the cam shown in FIG. 1–9.

FIG. 11 is a schematic side view of the contact system of the invention in a first condition of actuation prior to insertion of a board in the connector.

FIG. 12 is a view similar to FIG. 11 but with the board inserted in the connector.

DETAILED DESCRIPTION OF THE INVENTION

Figure 1:
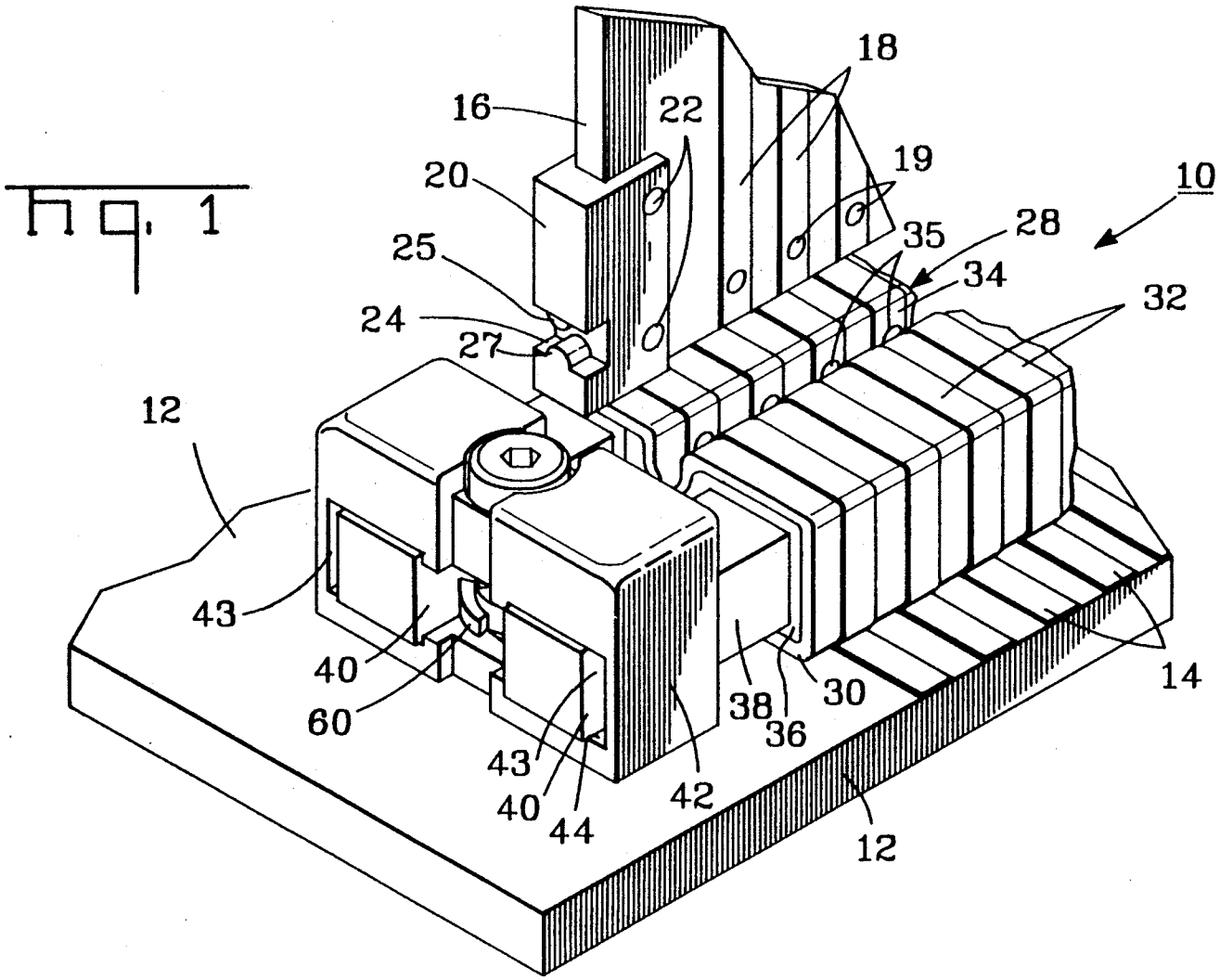
FIG. 1 is a perspective view, substantially enlarged from actual size, of one end of a connector in accordance with the invention; one of two printed circuit boards shown prior to engagement within the connector.

Referring now to FIG. 1, the edge end of a connector of a type utilized to provide large numbers of interconnections on close centers between printed circuit boards is shown. Reference is hereby made to U.S. patent application No. 07/610,871 filed Nov. 8, 1990 drawn to a high density electrical connector for a description of the type of connector shown in FIG. 1. Reference is also made to U.S. patent application 07/610,619 filed Nov. 8, 1990 drawn to an electrical connector using SMA springs, the springs being employed to effect a controllably variable contact force for the connector. The invention of the present connector is related to these earlier filed applications and represents an improvement thereover in certain respects.

In FIG. 1, the connector assembly 10 is shown to include a first printed circuit board 12 and a second board 16 which each carry conductive traces such as 14 and 18, respectively, on the surfaces thereof. The traces lead to other circuit paths, either buried within the boards, more typically in the first board 12 which represents a multi-layer mother board, and to components, typically mounted on the second board which represents a daughter board. The circuits interconnect the components of daughter boards to form an electronic system function such as for a computer, business machine, communication apparatus, or the like. With the increased complexity of such devices and systems, the numbers of functions, logic and memory, delay and display, have increased to the point that circuit traces must be placed on centers of 0.050 inches or less with the boards having multiple rows of contacts on the surfaces thereof as in the manner shown in the first mentioned U.S. patent application. Daughter boards 16 can have dimensions extending to 12 inches or considerably more in width with mother board widths of 18 inches or more being employed for the larger systems. The first board 12 may carry a relatively large number of second boards 16 which must be interconnected together to provide a system function.

The second board, board 16, includes at the outside edges, one edge only shown in FIG. 1, a cam block 20 secured to the board by fasteners as at 22 and including a doubled faced cam slot 24 including lower and upper curved cam surfaces 25 and 27 engaged by a cam in a manner to be described hereinafter relative to FIG. 10.

The invention connector 28 is comprised of an assembly, including a pair of spaced apart flexible film circuits 30, each having circuit traces thereon, traces 32 being shown in FIG. 1 for the right-handed element 30 and traces 34 being shown for the left-handed element. The flexible insulating film which carries these traces is wrapped around a plastic sleeve 36 as shown in FIG. 1 through which is fitted a solid and structurally rigid rod 38 in a manner indicated also in the first mentioned U.S. Patent Application. The films 30 are typically bonded to the sleeves 36 to preclude movement of the films and the traces 32, 34 relative to such rod. Each of the traces 32 and 34 carries an array of contact pads 33 aligned to engage the contact areas on circuit traces 14, extending beneath the circuit films 30 as shown in FIGS. 11–14. Contact areas 19 are located on the circuit traces 18 of board 16 in the manner shown in FIG. 1 and are made to engage contact areas 35 on the circuit traces 32 and 34. It is to be understood that the traces shown in FIG. 1 are illustrative and that several rows of contacts may be utilized for both the first and second boards in a manner disclosed in the first-mentioned application.

Figure 5:
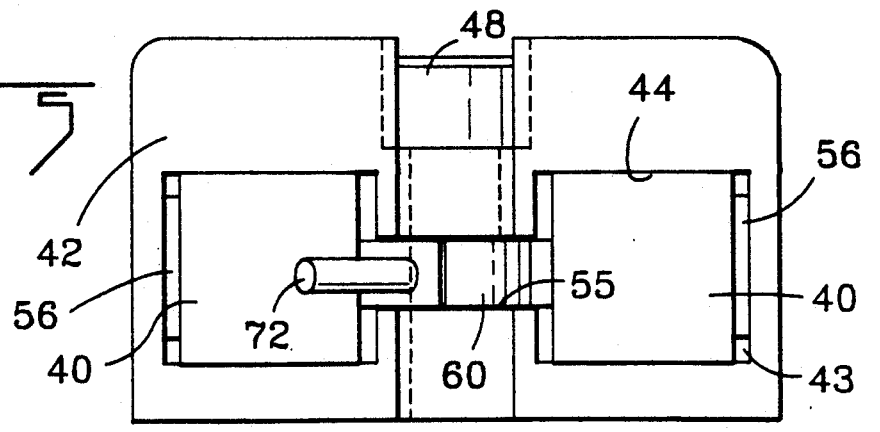
FIG. 5 is an end view, in elevation, of the connector shown in FIG. 1.

As can be discerned from FIG. 1, the rods 38 extend to include ends 40 resting within and held by a mounting member 42 which includes a closed block typically formed of metal to be rigid and capable of withstanding substantial stresses. Block 42 includes an interior relief 44 best shown in FIG. 2. This relief extends across the interior of the block and has surfaces adapted to receive and hold in sliding engagement, top and bottom, the ends 40 of rods 38 in the manner shown in FIG. 5.

Figure 2:
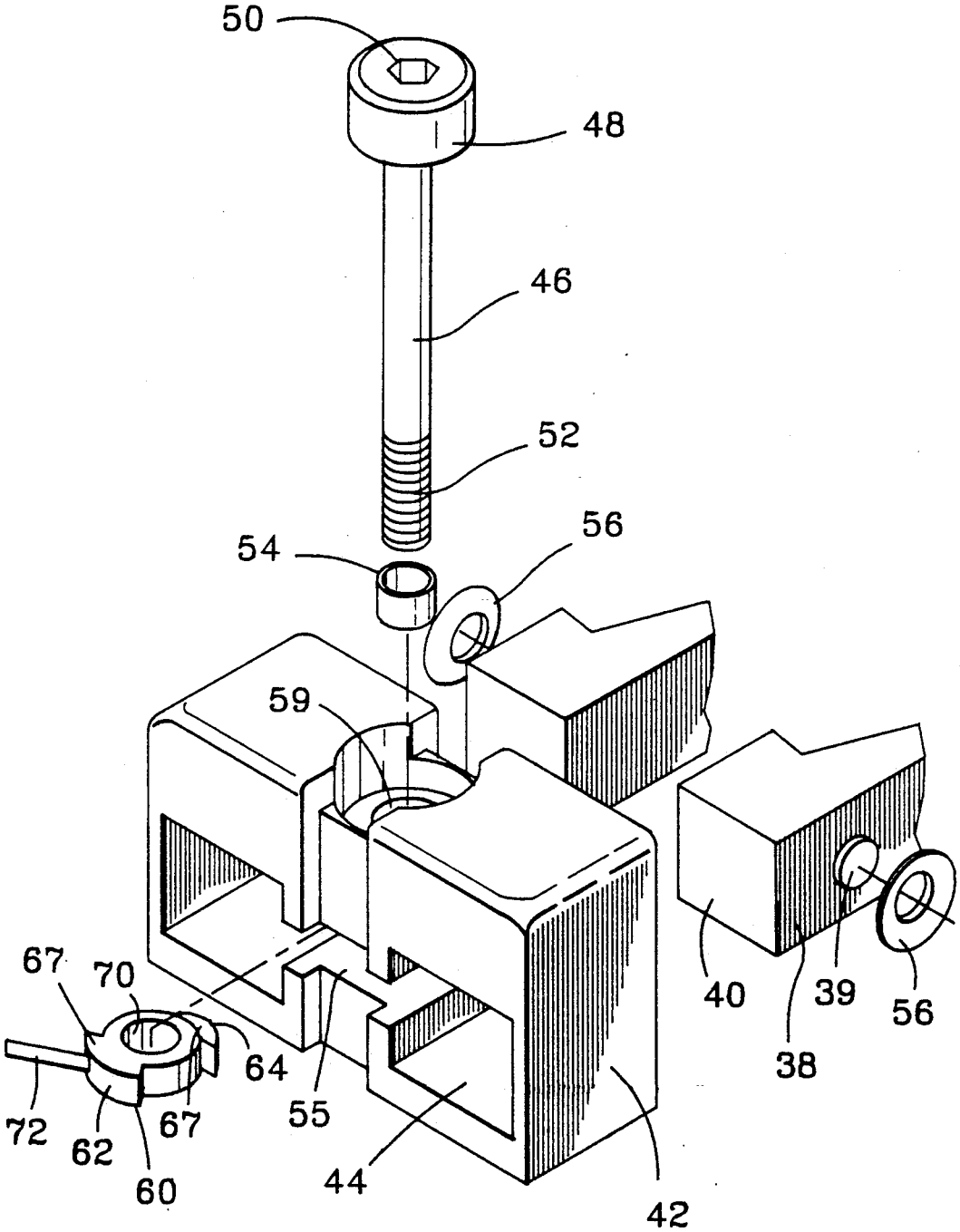
FIG. 2 is an exploded view in perspective of the mechanical parts of the connector shown in FIG. 1.
Figure 3:
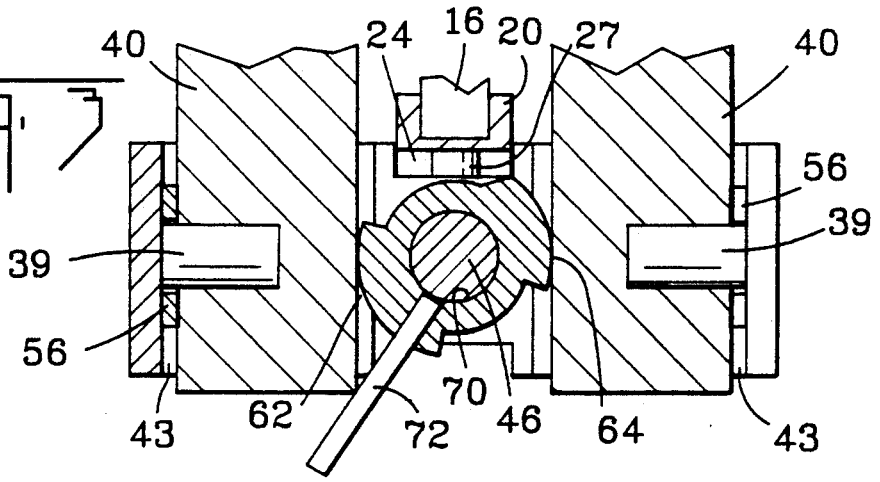
FIG. 3 is a plan view in partial section of the connector shown in FIG. 1 in one condition of actuation.
Figure 4:
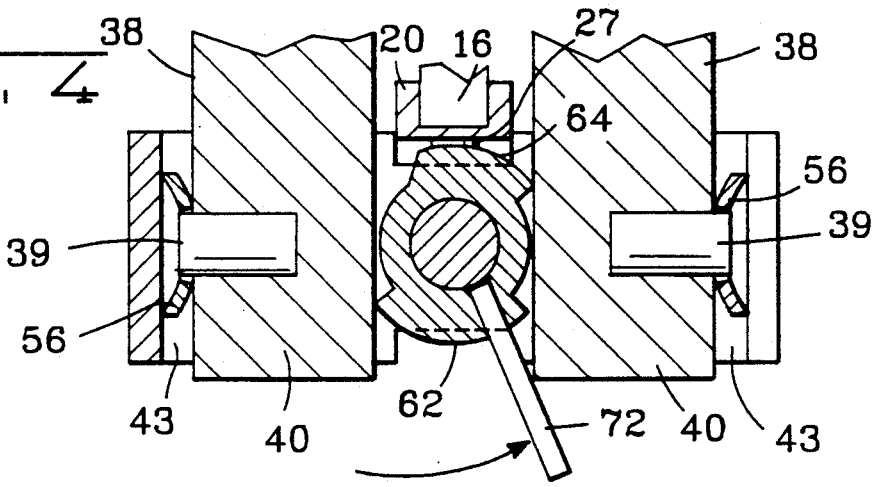
FIG. 4 is a view of the structure of FIG. 3 in another condition of actuation.

As part of the mounting structure of the invention, there is included a fastener in the form of a bolt 46 headed as at 48 and carrying therein a relief 50 which can be driven to rotate the bolt 46. The bolt includes, on the lower end, threading 52 which is extended through block 42, a shoulder spacer 54, an aperture 59, an aperture in the board 12, not shown, and a support plate beneath board 12, also not shown, to be engaged by an appropriate fastener nut which clamps the block 42 rigidly to the motherboard 12. The mounting of block 42 also aligns the block relative to the circuit traces 14 on board 12 and serves as an alignment fixture to receive board 16 and align the traces 18 thereon relative to traces 14. Reference may be had to the second-mentioned U.S. patent application for teaching of a support structure extending beneath the board 12. As can be seen in FIGS. 2–4, each of the ends 40 of rods 38 include a member 39 projecting from the outside side which serves to align and position a spring 56, shown as a bellville washer spring in FIGS. 2–4. The springs 56 operate on rods 38 in conjunction with blocks 42 to drive such rods inwardly towards the center of the block in the manner shown in FIGS. 3 and 4, FIG. 3 showing the rods disposed outwardly, compressing springs 56, and FIG. 4 showing the rods driven inwardly by the springs 56.

Referring to FIGS. 1–5, there is included centered on the bore 59 and block 42 a cam 60 which includes a pair of radially disposed vertical cam surfaces 62 and 64 as well as a further pair of horizontal cam surfaces 67 and 69 on the top and bottom surfaces, respectively, of cam 60 which are shown in FIG. 10. Cam 60 has a central bore 70 through which is fitted a portion of the bolt 46 to support the cam for rotary movement and hold the cam centered within block 42 resting on the surface 55 in the manner shown in FIG. 5. Cam 60 further includes an operating arm 72 extending therefrom to facilitate rotation of the cam within block 42.

As can be discerned in FIG. 3, the arm 72 can be rotated in a clockwise sense to drive the cam and the rods 38 through an engagement with the ends 40 relatively outward in the block 42 compressing springs 56 as guided by pins 39. This serves to open the circuits carried by the rods thereon, driving sleeves 36, films 30, and the conductive traces 32 and 34 in an outward sense to receive the board 16 inserted down therebetween under essentially no or very low frictional loading with respect to the contact surfaces of the board and the connector. FIG. 11 shows schematically the contact traces 18 and contacts 19 prior to the insertion of board 16 into the connector and also shows the engagement of the contacts 33 of the connector with the contact surfaces on traces 14 to effect a wipe. This occurs by virtue of the cam surfaces 62 and 64 driving the rods 38 through engagement with the interior surfaces of portions 40 as mentioned. This movement thus effects a wipe on the board 12, between the contacts 33 of the connector, flexible circuit, and the contact of the traces 14 and is followed by an insertion of the board into the position shown in FIG. 12 with the contacts 19 aligned with contacts 35 of the circuits 32. At this point in the cycle, operating arm 72 is manipulated as in the manner of FIG. 4 to drive the lobes carrying surfaces 62 and 64 clear of engagement with the end elements 40 of rods 38. This results in springs 56 driving the rods inwardly to the position shown in FIG. 4 to effect a backwipe of the contacts 33 with traces 14 in the manner shown in FIG. 13 and an engagement of the contacts 35 with the contacts 19 connected to traces 18 of board 16 and wiped thereacross. This occurs as the cam 60 is rotated to the position of FIG. 4 by a pair of vertical cam surfaces, including a top surface 67 and a bottom surface 69 as shown in FIG. 10, that are caused to engage the surfaces of cam slot 24 of board 16. The mechanism includes having the cam shape 67 such that as it enters and engages the upper surface 25, as shown in FIG. 10, driving the board 16 upwardly, followed immediately during continuing rotation of the cam by the engagement with the surface 69 and surface 27 of the cam slot to drive the board 16 downwardly. Manipulation of the cam 60 to rotate to the position shown in FIG. 3 and then return to the position shown in FIG. 4 will thus effect a first wipe and backwipe of the contacts engaging board 12 and a wipe and backwipe of the contacts engaging board 16. The extent of wiping motion, the length thereof, and of backwipe can be readily controlled by the shape of the cam surfaces 62, 64, 67, and 69 and follower surfaces 25 and 27. For electrical connectors, wipe displacements on the order of 0.010 inches or slightly more and backwipe displacement on the order of half of that dimension or slightly less are sufficient to provide a cleaning, fresh metal contact between mated contacts being driven under normal pressures such as those on the order of those mentioned relative to gold and tin surface finishes. Cam surface shapes can readily accommodate such displacements for wipe and backwipe. In fact, with the provision of wipe and backwipe, normal forces can be somewhat reduced from the 100 grams used for gold finishes.

A mounting mechanism, including block 42, the cam and mounting hardware shown in FIGS. 1 and 2 would be replicated at the opposite end, not shown, of the board 16, and similarly mounted to board 12 to rigidly position the rods and associated flexible circuits traces and contacts on board 12. In practice, contemplating an unloaded connector 28, the cams at each end would be manipulated to open the connector, a board 16 inserted within the connector rod structures, and then the cams simultaneously manipulated, as by each hand of an operator to effect the closure driving both ends of the rods 38 simultaneously.

It is contemplated that mechanisms, including motors, may be utilized to drive the operating arms 72 and the cams 60 at each end of a connector to facilitate a remote operation of the connector.

Figure 6:
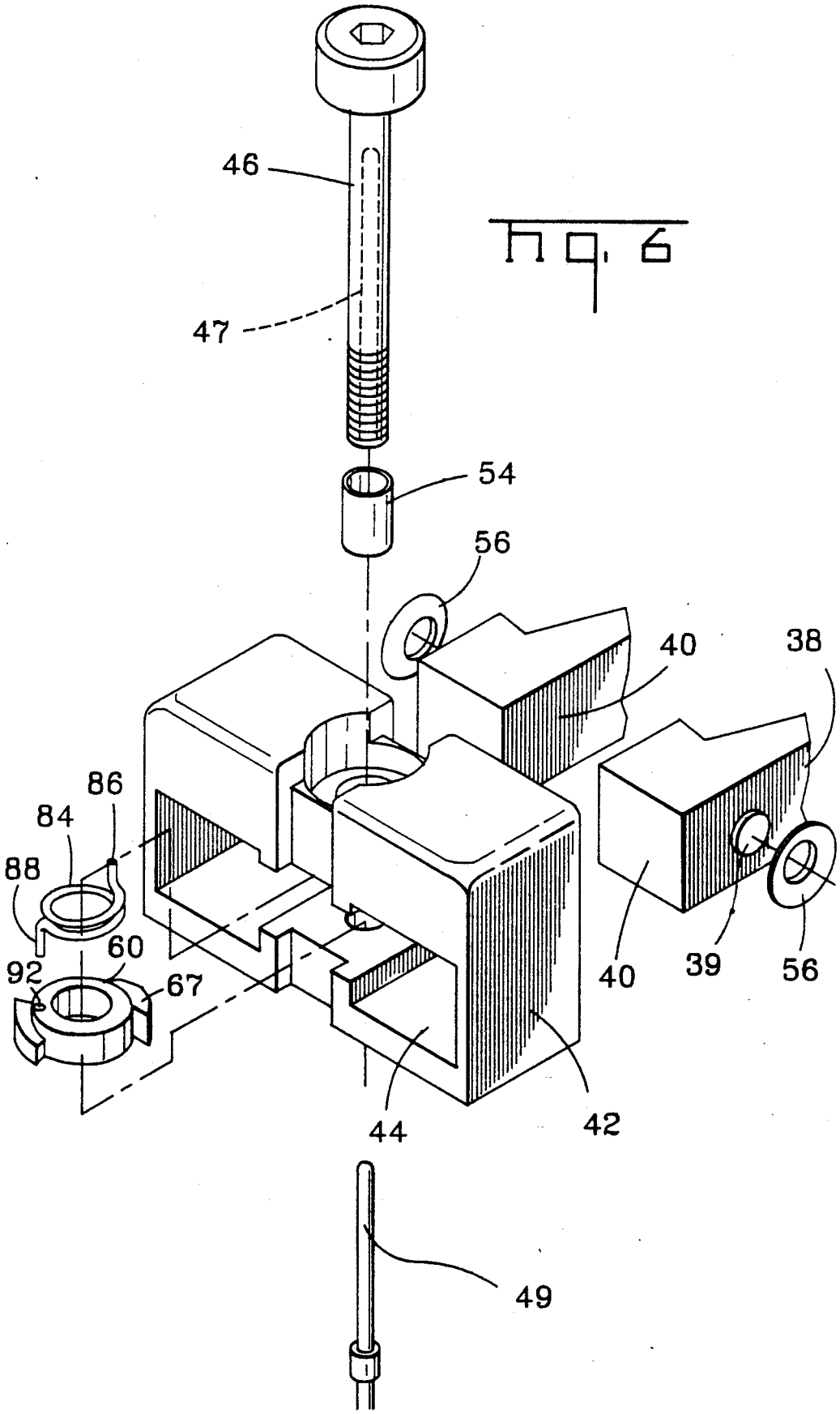
FIG. 6 is an exploded view of components of a connector like that of FIG. 1 with the addition of an SMA spring element and SMA heater.
Figure 7:
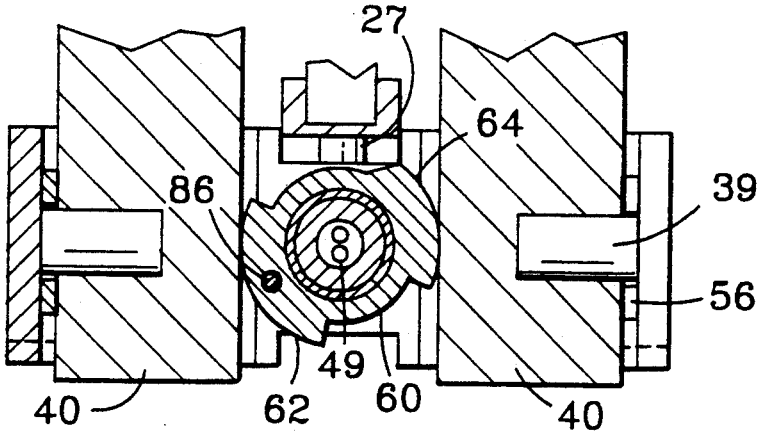
FIG. 7 is a plan and sectional view of the assembled elements of FIG. 6 in one condition of actuation.
Figure 8:
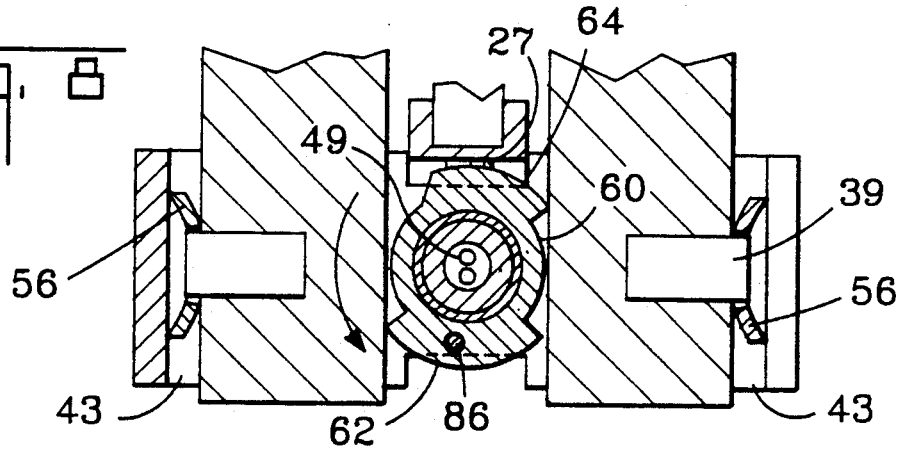
FIG. 8 is a view of the elements of FIG. 7 in an alternative condition of actuation.
Figure 9:
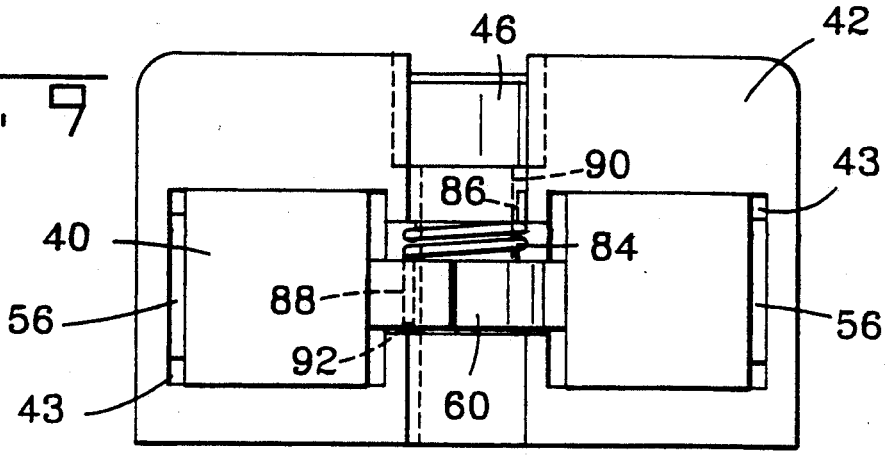
FIG. 9 is an end view of the connector formed of the parts shown in FIG. 6.
Figure 13:
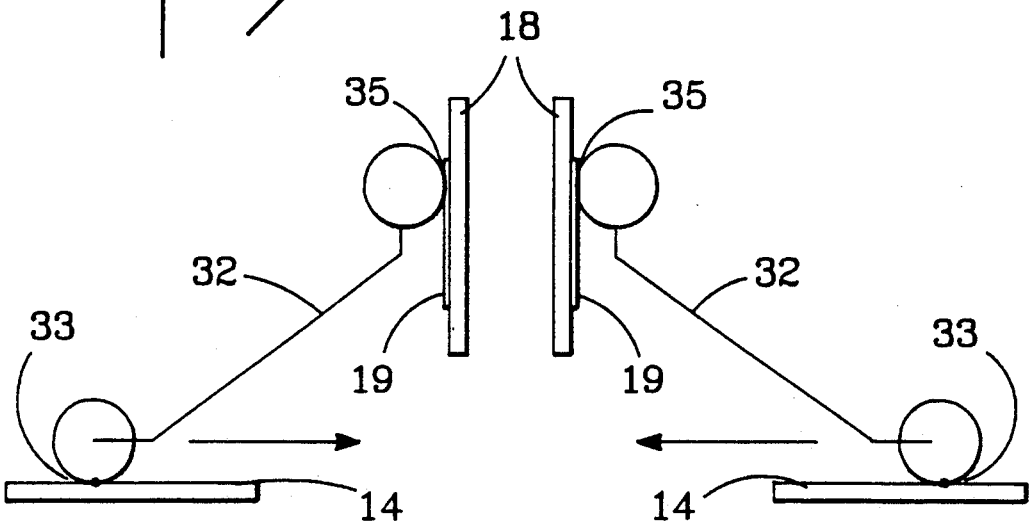
FIG. 13 is a view similar to that of FIGS. 11 and 12 following actuation to effect engagement and wipe of the contacts of the connector.
Figure 14:
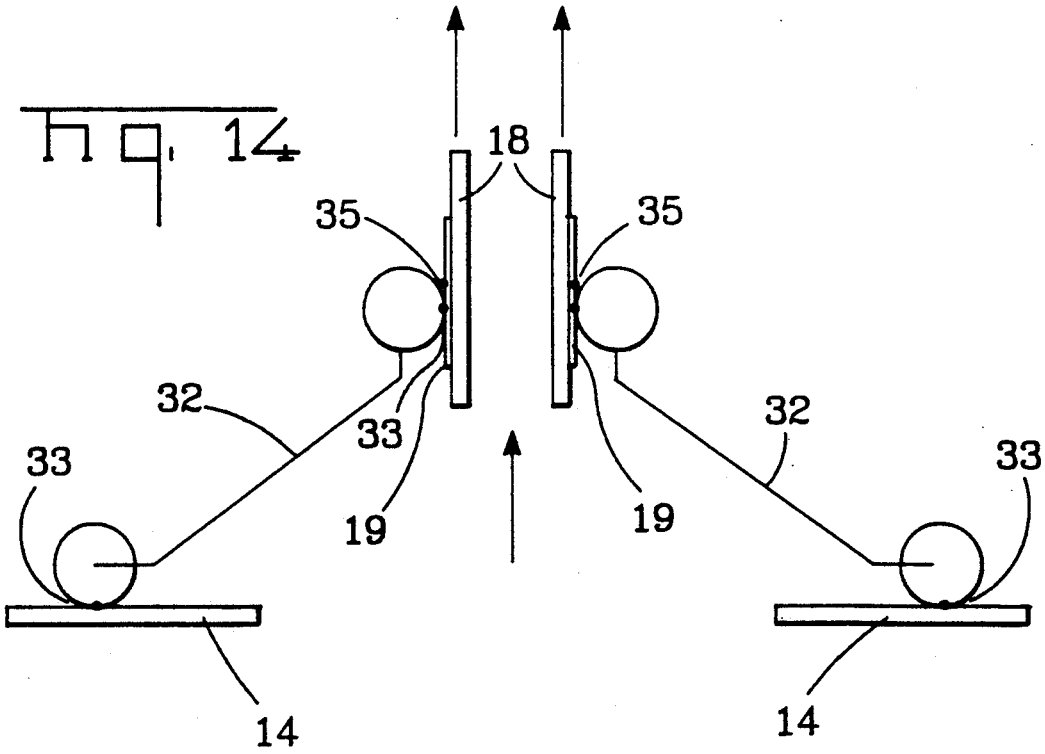
FIG. 14 is a view of the contacts following actuation to achieve backwipe of the contacts.

FIG. 6 shows an exploded view of one end of just such a structure, the elements common with those heretofore described being similarly enumerated. Additionally included within the fastener, bolt 46, is an interior bore 47 adapted to receive inserted therein, a heat unit 49 which may be in the form of a small Calrod unit having a resistance element coupled to a thermostat and operable to be driven by electric current to provide a given temperature to the element and to its surrounding structure. Also additionally shown is a spring element 84 which is a form of thermal motor, when comprised of shaped memory alloy material, a type of material which is displaced mechanically responsive to the application of thermal change. The so-called SMA springs may be commercially purchased with a wide range of characteristics in terms of amount of movement relative to temperature range and strength or stress of spring over a given temperature range. SMA springs may be acquired which exhibit one-way or two-way action, going from a weak state at a low temperature to a strong state at a high temperature. Reference may be had to the publication "Memory Metal Electromechanical Actuator," NASA Tech Brief, Winter 1983, Volume 8, Number 2, Item 62; J. P. L. Invention Report N. P. 0. 1596015414 describing SMA spring characteristics. In accordance with this further motor driven embodiment of the invention, the spring 84 is made to include, in addition to a suitable number of turns, two turns being shown in FIG. 9, a pair of projecting ends 86 and 88. The spring 84 is placed on top of the cam 60 and centered by bolt 46 in the manner shown in FIGS. 7 and 8. The end 86 of spring 84 extends upwardly into an aperture 90 in the manner shown in FIG. 9 in block 42. The end 88 of spring 84 extends downwardly into an aperture 92 in cam 60 in the manner shown in FIG. 9. In accordance with the invention, heater 49 extended up within bolt 46 is actuated to heat the bolt and thereby heat SMA spring 84 from an environmental temperature such as on the order of 70 degrees Fahrenheit to a higher temperature such as on the order of 100 degrees Fahrenheit. The spring characteristics are chosen to cause the spring to be actuated to rotate the cam from the condition shown in FIG. 8 to the condition shown in FIG. 7, thus camming the rod elements apart, to allow loading of the board 16 therebetween and wipe of contacts 19 and 33. Thereafter, upon cooling, the springs 56 operate to rotate the cam back to the condition shown in FIG. 8 providing wipe and backwipe to contacts 19 and 35 of board 16 and backwipe for contacts 19 and 33 in the manner indicated in FIGS. 11–14. The invention fully contemplates the use of different temperature ranges through the appropriate selection of SMA material and heater and thermostat operation and further contemplates the use of SMA materials, in cooperation with conventional materials, which function through a negative temperature range by using an appropriate cooling of the SMA spring to cause the cams to open the connector, with a return to an environmental range on the order of 70 degrees or more, allowing the spring to restore the connector and the final wipe and backwipe of the board 16.

The invention fully contemplates a wide range of mechanical and motor-driven cam operations to effect wipe and backwipe of high density electrical connectors. Use with single sided circuit boards employing a single rod and current arrangement is also contemplated.

Having now described the invention in terms intended to enable a preferred practice thereof, claims are appended intended to define what is inventive.

We claim:

1. An electrical connector for interconnecting contact traces of first and second component boards each carrying surface-mounted contacts and said second board having a drive surface, said connector including mounting means affixed to the first board adapted to receive and hold the second board to align the contacts of each board in a spaced relationship, an interconnection means including a flexible circuit having contacts of the first and second boards and with the circuit contacts interconnected by circuit tyraces, the interconnection means further including a rod means mounting and joining said flexible circuit and operable to support said circuit structurally and drive said circuit in movement to effect an interconnection of the contacts of the second board to the contacts of the first board through the circuit contacts and circuit traces, said mounting means including interior surfaces carrying the ends of the said rod means and cam means fitted in said mounting means and rotatably operable to effect a displacement of said rod means to drive the said circuit contacts in movement against the contacts of the first and second boards, said cam means including cam surfaces shaped to drive said drive surfaces in first and second displacements to effect wipe and backwipe of the contacts of the second board by said circuit contacts to provide a resulting low-resistance, stable electrical interface between said contacts.

2. The connector of claim 1 wherein the said cam means includes surfaces engaging the said rod means to provide a drive of the said rod means in first and second directions to effect wipe and backwipe of the contacts of the said circuit with the contacts of at least one of said boards.

3. The connector of claim 1 wherein the said second board includes drive surfaces proximate the said cam means and the said cam means includes a cam surface to drive said rod means and said drive surfaces to provide wipe and backwipe of the circuit contacts with the contacts of said first and second boards.

4. The connector of claim 1 wherein the said cam means includes a shape memory alloy spring operable upon thermal change to drive said cam to effect a drive of said rod means and means for effecting said thermal change.

5. The connector of claim 4 including further spring means to drive said rod means and displace said circuit contacts in an opposite direction to provide backwipe relative to the drive of said cam means by said shape memory alloy spring.

6. The connector of claim 1 wherein the said cam means includes opposing pairs of surfaces on the sides and top thereof operable upon rotation of said cam means to effect a wipe and backwipe of the contacts of said circuit and the contacts of said first and second boards.

7. The connector of claim 6 wherein the one of said pairs of cam surfaces is operable upon rotation in a single direction of said cam means to drive the contacts of the said second board in wipe and backwipe with engagement with the contacts of the said circuit.

8. The connector of claim 1 further including a second rod means with each of the rod means having a circuit supporting contacts thereon and the said mounting means includes a pair of spaced-apart bearing surfaces each having support surfaces to accommodate the rod means for displacement and further includes means supporting said cam means for a rotary movement in said mounting means to effect displacement of said rod means simultaneously.

9. The connector of claim 8 including a spring operable to engage the said rod means and be compressed thereby by operation of the said cam means driving said rod means so as to drive said rod elements oppositely upon reverse rotation of the said cam means.

10. The connector of claim 9 including a second spring having shape memory alloy characteristics and operable to drive said cam means responsive to thermal change.

11. The connector of claim 10 including means to effect thermal change to said second spring.

* * * * *

UNITED STATES PATENT OFFICE

CERTIFICATE OF CORRECTION

Patent No. 5,098,309 Dated March 24, 1992

Inventor(s) Frederick R. Deak, David J. Goetzinger, Robert M. Renn

It is certified that error appears in the above-identified patent and that said Letters Patent is hereby corrected as shown below:

In claim 1, column 6, line 59, after the word "contacts" insert --positioned in alignment with the contacts--; line 60, the word "tyraces" should be --traces--.

Signed and Sealed this

Twenty-eighth Day of September, 1993

Bruce Lehman

*Attest:*

BRUCE LEHMAN

*Attesting Officer*

*Commissioner of Patents and Trademarks*